US012495907B2

(12) United States Patent
King

(10) Patent No.: US 12,495,907 B2
(45) Date of Patent: Dec. 16, 2025

(54) INTERCOURSE FACILITATING ADJUSTABLE BENCH FURNITURE

(71) Applicant: Raymond King, Shelby, MI (US)

(72) Inventor: Raymond King, Shelby, MI (US)

( * ) Notice: Subject to any disclaimer, the term of this patent is extended or adjusted under 35 U.S.C. 154(b) by 539 days.

(21) Appl. No.: 17/505,937

(22) Filed: Oct. 20, 2021

(65) Prior Publication Data

US 2022/0279931 A1 Sep. 8, 2022

Related U.S. Application Data

(60) Provisional application No. 63/158,030, filed on Mar. 8, 2021.

(51) Int. Cl.

| | |
|---|---|
| ***A47C 15/00*** | (2006.01) |
| ***A47C 7/50*** | (2006.01) |
| ***A47C 7/52*** | (2006.01) |

(52) U.S. Cl.

CPC ..... *A47C 15/008* (2013.01); *A47C 7/5064* (2018.08); *A47C 7/52* (2013.01)

(58) Field of Classification Search

CPC ..... A47C 15/008; A47C 7/5064; A47C 7/52; A63B 21/00047; A63B 21/4029; A61B 6/04; A61B 6/0407; A61F 5/00; A61G 13/0009; A61G 13/08; A61G 13/12; A61G 13/124; A61G 13/125; A61G 15/005; A61G 7/015; A61G 7/065

USPC ..... 128/845; 482/140, 141, 142, 145, 148; 600/38; 5/600, 602, 613, 617, 618, 621, 5/646, 649

See application file for complete search history.

(56) References Cited

U.S. PATENT DOCUMENTS

| | | | | | |
|---|---|---|---|---|---|
| 1,573,980 | A * | 2/1926 | Liptay | A61G 13/0018 | 297/372 |
| 3,006,643 | A * | 10/1961 | Ryan | A63B 21/00047 | 601/24 |
| 7,524,283 | B1 * | 4/2009 | Johnstone | A61H 19/50 | 600/38 |
| 2003/0126686 | A1 * | 7/2003 | Nash | A61H 19/50 | 5/657 |
| 2015/0038304 | A1 * | 2/2015 | Davenport | A63B 23/1218 | 482/123 |
| 2017/0188714 | A1 * | 7/2017 | Kaczmarek | A47C 15/008 | |

FOREIGN PATENT DOCUMENTS

| | | | | |
|---|---|---|---|---|
| CA | 2463341 C * | 2/2012 | | A47C 15/008 |
| EP | 497750 A1 * | 8/1992 | | A47C 16/04 |
| WO | WO-0239944 A2 * | 5/2002 | | A61G 1/017 |
| WO | WO-2014130098 A1 * | 8/2014 | | A47C 15/008 |

* cited by examiner

*Primary Examiner* — Caitlin A Carreiro

(74) *Attorney, Agent, or Firm* — Brennan, Manna & Diamond, LLC

(57) ABSTRACT

A safe and secure intercourse-facilitating adjustable bench device. The bench device is configured with a frame having vertical legs, U-shaped rails, an adjustable bench, footrests and wrist straps. The adjustable bench device can be adjusted both in height and inclination to perform sexual intercourse in a variety of positions. The bench device can be adjusted and locked in an inclined, flat or declined position. The height of the frame can also be adjusted and can be used for performing vaginal, anal and oral sex, even by obese users or users with injuries, illnesses or limited physical movement.

17 Claims, 5 Drawing Sheets

INTERCOURSE FACILITATING ADJUSTABLE BENCH FURNITURE

CROSS-REFERENCE TO RELATED APPLICATION

The present application claims priority to, and the benefit of, U.S. Provisional Application No. 63/158,030, which was filed on Mar. 8, 2021 and is incorporated herein by reference in its entirety.

FIELD OF THE INVENTION

The present invention relates generally to the field of benches. More specifically, the present invention relates to an intercourse-facilitating adjustable bench device that allows users to easily maintain stability and balance when performing multiple sexual intercourse positions. The device includes an adjustable bench that can be tilted and locked in a flat, inclined or declined position for performing sexual intercourse. Footrests and wrist straps are detachably-secured to a frame that has a vertical front and rear legs supported by U-shaped rails for stability. The frame is sturdy and provides a stable and secure device for sexual intercourse, especially for users with injuries, obese users and users with limited physical movements. Accordingly, the present disclosure makes specific reference thereto. Nonetheless, it is to be appreciated that aspects of the present invention are also equally applicable to other like applications, devices and methods of manufacture.

BACKGROUND OF THE INVENTION

Humans reproduce by sexual intercourse. Further, humans engage in sex for reasons other than reproduction, including physical and emotional pleasure. Humans perform sexual intercourse in different positions, including vaginal sex, oral sex and anal sex.

Additionally, having a regular, joyful and sensible sexual relationship between people is a very important part of life for physical and emotional pleasure. A sexual relationship helps in maintaining a good relationship between people. Further, sexual relationships vary between a wide range of activities.

For a successful sexual relationship, it is important that all people enjoy and reach sexual satisfaction. Generally, people constantly strive to improve their mutual enjoyment, diversify and try new relative sexual positions and enhance their capability to excite each other during sexual intercourse. However, people with injuries, body aches, or limited mobility may find it difficult to enjoy sexual intercourse and to try new sexual positions on conventional beds and other surfaces. For example, paraplegics, people with back and spine problems, infirmed people, obese people and people with other disabilities may find it both difficult and painful to have intercourse in conventional or new positions. This leads to a lack of sexual satisfaction in such people and in their sexual partners. Known apparatus that help people having sexual intercourse include tables, fixed chairs, wheelchairs, etc. A problem with such devices is that, in many cases, it is virtually impossible to have intercourse in the desired position.

Therefore, there exists a long felt need in the art for a bench device that can be adjusted for users to try different sexual positions. There is also a long felt need in the art for a bench device that can be used by injured and disabled users for performing sexual intercourse. Additionally, there is a long felt need in the art for a bench device that can be easily used in performing a variety of sexual acts. Moreover, there is a long felt need in the art for a bench device that ensures that users reach sexual satisfaction, while maintaining stability and balance. Further, there is a long felt need in the art for a bench device that can be locked in an adjustable position for performing sexual intercourse. Finally, there is a long felt need in the art for a bench device that overcomes the problems faced by users due to fixed and conventional beds and other furniture while performing sexual intercourse.

The subject matter disclosed and claimed herein, in one embodiment thereof, comprises an adjustable bench device for secure and joyful sexual intercourse. The adjustable bench device comprises an adjustable bench that can be tilted in an inclined, declined or flat position for performing sexual intercourse in a variety of positions, a frame, a pair of detachably-secured footrests for resting a user's feet during sexual intercourse and a pair of detachably-secured wrist straps to tie a user's wrists during sexual intercourse. Further, the height of the footrests, wrist straps and adjustable bench are adjusted by mounting the footrests, wrist straps and adjustable bench into the holes disposed on the rear legs and front legs of the frame of the device.

In this manner, the novel adjustable bench device for sexual intercourse of the present invention accomplishes all of the forgoing objectives, and provides a relatively secure, stable, portable and convenient apparatus, which allows sexual partners to perform sexual intercourse in a variety of positions. The adjustable bench device allows users with injuries and physical limitations to adjust the bench as per their preferences to enjoy sexual intercourse.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises an adjustable bench device for sexual intercourse. The adjustable bench device comprises a frame that has a first front leg and a first rear leg connected through a first U-shaped rail, a second front leg and a second rear leg connected through a second U-shaped rail, wherein the first front leg and the first rear leg are detachably-secured to a first base arm, and the second front leg and the second rear leg are detachably-secured to a second base arm. The adjustable bench device also comprises an adjustable bench that can be positioned in one of inclined, flat or declined positions, and is supported by an adjustable front bench support that connects said first front leg and said second front leg together and by an adjustable rear bench support that connects said first rear leg and said second rear leg together. The adjustable front bench support is configured to adjust vertically along the first front leg and said second front leg and the adjustable rear bench support is configured to adjust vertically along the first rear leg and said second rear leg, to adjust the height and position of the adjustable bench. The adjustable bench is used by sexual partners to sit or lie on during sexual intercourse.

In yet another embodiment of the present invention, an adjustable bench device for secure and joyful sexual intercourse is disclosed. The adjustable bench device includes an adjustable bench that can be tilted in an inclined, declined or flat position for performing sexual intercourse in a variety of positions, a pair of detachably-secured footrests for resting a user's feet during sexual intercourse, and a pair of detachably-secured wrist straps to tie a user's wrists.

In yet another embodiment of the present invention, an adjustable bench device for performing sexual intercourse in a variety of positions is disclosed. The adjustable bench device comprises an adjustable bench that is adjustable on a pair of front legs and a pair of rear legs, the adjustable bench rests on an adjustable front bench support that connects a first front leg and a second front leg and on an adjustable rear bench support that connects a first rear leg and a second rear leg. Further, the adjustable bench is inclined when said adjustable rear bench support is positioned higher than the adjustable front bench support, and wherein the adjustable bench is declined when said adjustable rear bench support is positioned lower than the adjustable front bench support, and wherein the adjustable bench is flat when said adjustable rear bench support is positioned at the same level as the adjustable front bench support.

In yet another embodiment of the present invention, a sexual intercourse adjustable device is disclosed. The device includes a frame having a pair of connected rear legs and a pair of connected front legs, wherein the connections are made through U-shaped rails, an adjustable bench mounted on support arms that are disposed between said pair of connected rear legs and said pair of connected front legs, said adjustable bench is configured to be in one of inclined, flat or declined positions. Further, the adjustable bench can be replaced by a kneeling platform for oral sex.

In yet another embodiment, the height of the footrests, wrist straps and adjustable bench can be adjusted by mounting them in the holes disposed on the rear legs and front legs.

In yet another embodiment of the present invention, the adjustable bench comprises cushioning and padding such as cellular polyurethane foam, rubber or silicon, etc., to comfort users while performing sexual intercourse, and can also contain shoulder tubes.

In yet another embodiment of the present invention, a method of having sexual intercourse on an adjustable bench device is described. The method includes adjusting and locking an adjustable bench at a desired angle, adjusting the footrests at a desired height, adjusting the wrist straps at a desired height and performing sexual intercourse by lying on the adjustable bench.

The advantage of the adjustable bench device of the present invention is that it allows users to easily maintain stability and balance during sexual intercourse, and functions as a tool for physically-limited users to enjoy sexual intercourse with their partner. The device can be used for various types of sexual positions and can be used for vaginal, anal and oral sex.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
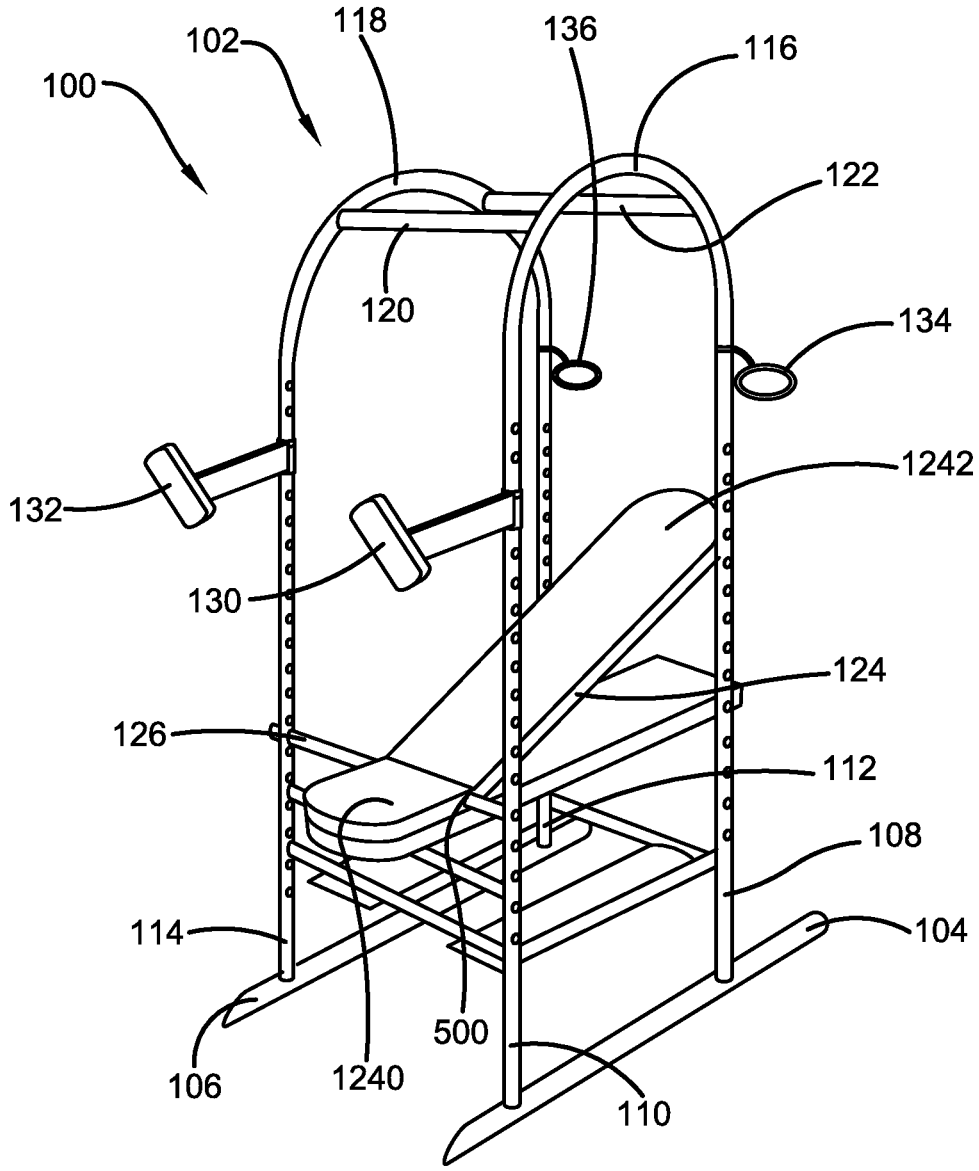
FIG. 1 illustrates a perspective view of one embodiment of the adjustable bench device for sexual intercourse of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As stated supra, there exists a long felt need in the art for a bench device that can be adjusted for users to try different sexual positions. There is also a long felt need in the art for a bench device that can be used by injured and disabled users for performing sexual intercourse. Additionally, there is a long felt need in the art for a bench device that can be easily used for performing multiple sexual acts. Moreover, there is a long felt need in the art for a bench device that ensures that users reach sexual satisfaction while maintaining stability and balance. Further, there is a long felt need in the art for a bench device that can be locked in an adjustable position for performing sexual intercourse. Finally, there is a long felt need in the art for a bench device that overcomes the problems faced by users due to fixed and conventional beds and other furniture, while performing sexual intercourse.

The present invention, in one exemplary embodiment, is a novel intercourse-facilitating adjustable bench device. The adjustable bench device comprises a frame having a first front leg and a first rear leg connected through a first U-shaped rail, a second front leg and a second rear leg connected through a second U-shaped rail, and wherein the first front leg and the first rear leg are detachably-secured to a first base arm, and wherein the second front leg and the second rear leg are detachably-secured to a second base arm. The adjustable bench device also comprises an adjustable bench that can be positioned in one of an inclined, flat or declined position, and is supported by an adjustable front bench support that connects said first front leg and said second front leg together and by an adjustable rear bench support that connects said first rear leg and said second rear leg together. The adjustable front bench support is configured to adjust vertically along the first front leg and said second front leg, and the adjustable rear bench support is configured to adjust vertically along the first rear leg and said second rear leg to adjust the height and position of the adjustable bench.

Referring initially to the drawings, FIG. 1 illustrates a perspective view of one embodiment of the adjustable bench device for sexual intercourse of the present invention. The adjustable bench device 100 for sexual intercourse is configured to be adjusted and locked in a specific position and orientation which allows users to enjoy sexual intercourse while maintaining stability and balance. In addition, the device can also be used for weightlifting involves weights, dumbbells, or bodyweight exercises. More specifically, the adjustable bench device 100 comprises a frame 102 that includes a pair of base arms 104, 106. A first base arm 104 has a first rear leg 108 and a first front leg 110 extending from the first base arm 104 and detachably-secured to the first base arm 104. A second base arm 106 has a second rear leg 112 and a second front leg 114 extending from the second base arm 106 and detachably-secured to the second base arm 106. Further, the first rear leg 108 and the first front leg 110 are connected to each other at the top through a U-shaped rail 116. Similarly, the second rear leg 112 and the second front leg 114 are connected to each other at the top through a second U-shaped rail 118. A pair of connecting arms 120, 122 provides support and connects the U-shaped rails 116, 118. Specifically, the pair of connecting arms 120, 122 are positioned horizontally across the U-shaped rails 116, 118 to secure them together. The rear legs 108, 112 and the front legs 110, 114 are telescoping, thus the overall height of the frame 102 can be adjusted as per the needs and/or wants of the users. The base arms 104, 106 are heavy and durable and provide stability to the users performing sexual intercourse on the adjustable bench device 100.

Additionally, an adjustable bench 124 is mounted on the frame 102. The adjustable bench 124 comprises an adjustable front bench support 126 connecting the front legs 110, 114 and an adjustable rear bench support 128 connecting the rear legs 108, 112. The front bench support 126 and the rear bench support 128 support the adjustable bench 124, and allow the adjustable bench 124 to be positioned in a desired orientation and/or height. In addition, both supports 124, 128 can be used to support the hands of the user and allow the user to hold/lift their body. The adjustable front bench support 126 is configured to move along the lengths of the front legs 110, 114 and the adjustable rear bench support 128 is configured to move along the lengths of the rear legs 108, 112, such that the front of the adjustable bench 124 could be higher or lower than the rear of the adjustable bench 124. Specifically, the front bench support 126 and the rear bench support 128 utilize mounting assemblies which comprise mounting pins 302 (shown in FIG. 3), said mounting pins 302 protrude into one of the holes 204 (shown in FIG. 2) of the front legs 110, 114 or rear legs 108, 112. Further, the adjustable bench 124 is detachably-secured to the frame 102 and can be replaced with any other suitable bench for any other sexual position or activity as is known in the art.

Additionally, the adjustable bench device 100 also comprises at least one pair of footrests 130, 132 for providing support to a user's legs during sexual intercourse. The pair of footrests 130, 132 is detachably-secured to the front legs 110, 114. The footrests 130, 132 are height-adjustable along the length of the front legs 110, 114 to meet the needs and/or wants of users. In addition, the footrests 130, 132 can be flipped inward when not in use. The footrests 130, 132 are especially useful in a missionary sexual position and provide stability and security for the users. The adjustable bench device 100 comprises a pair of wrist straps 134, 136 for wrapping the user's hands. Specifically, a first wrist strap 134 is removably-secured to the first rear leg 108 and a second wrist strap 136 is removably-secured to the second rear leg 112. The wrist straps 134, 136 are adjustable in height along the lengths of the rear legs 108, 112 and can be removed if not required by the users. The wrist straps 134, 136 are preferably a strip of material equipped with hook and loop fasteners, or any other suitable fastener as is known in the art. The wrist straps 134, 136 secure around the wrist of a user disposed on said adjustable bench 124 to secure the user's wrist while using the adjustable bench 124. The wrist straps 134, 136 are preferably manufactured of fabric or other suitable breathable material as is known in the art.

The adjustable bench 124 allows one or more users to lie down for sexual intercourse and the seating member 1240 allows one or more users to sit. The bench 124 and seating member 1240 are further supported by a frame 1242. The adjustable bench 124 has a soft cushion layer for providing comfort to the users as well as a one-piece back and headrest. The soft cushion layer is manufactured from any suitable cushioning material as is known in the art. In the present embodiment, the dimensions of the frame 1242 of the adjustable bench 124 are approximately 6'(L)×2.5'(W)×0.75'(H), but can be any suitable size or shape as per the wants and/or needs of a user. In one embodiment, the frame 1242 may have its own cushion layer that is optimized and constructed to allow a user to kneel on the frame. The frame 1242 may also have a removable kneeling platform 600 to fulfil this same purpose. The bench 124 is preferably adjustable such that it can be inclined or declined within a 90-degree range of movement with respect to the frame 1242. In an alternative embodiment, the frame 1242 can also incline or decline within a 90-degree range of movement. Further, the bench 124 can be locked any number of incline or decline positions via an at least one clamp 500. In differing embodiments, the clamp may be any clamp 500 type known in the art, including but not limited to a quick-release clamp.

Accordingly, using the footrests 130, 132, wrist straps 134, 136 and the adjustable bench 124, the adjustable bench device 100 enhances a user's excitement and enjoyment of the sexual activity and aids users when their muscles get fatigued, and/or aids various users with physical limitations. The invention also aids disabled users and allows them to achieve a more joyful sex life.

Figure 2:
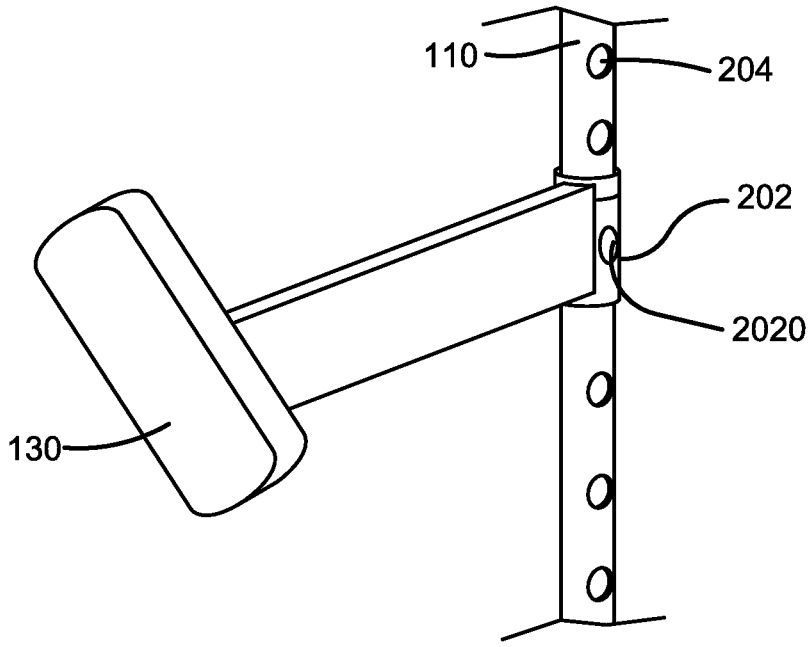
FIG. 2 illustrates a close-up view of the attachment of a footrest on the front leg of the adjustable bench device of the present invention in accordance with the disclosed architecture.

FIG. 2 illustrates a close-up view of the attachment of a footrest on the front leg of the adjustable bench device of the present invention. As shown, the first footrest 130 is adjustably-secured to the first front leg 110 using a mounting assembly 202. The mounting assembly comprises a hole 2020 which is aligned with one of the plurality of holes 204 disposed on the first front leg 110 and is engaged using a mounting pin 302 (shown in FIG. 3). The mounting assembly 202 can be secured to any hole 204, thus allowing a user to adjust the height and position of the footrest 130 on the first front leg 110. When not needed, the footrest 130 can be removed from the first front leg 110 and stored. It should also be appreciated that the same mechanism is used for attaching the second footrest 132 to the second front leg 114 using the corresponding mounting assembly 202.

Figure 3:
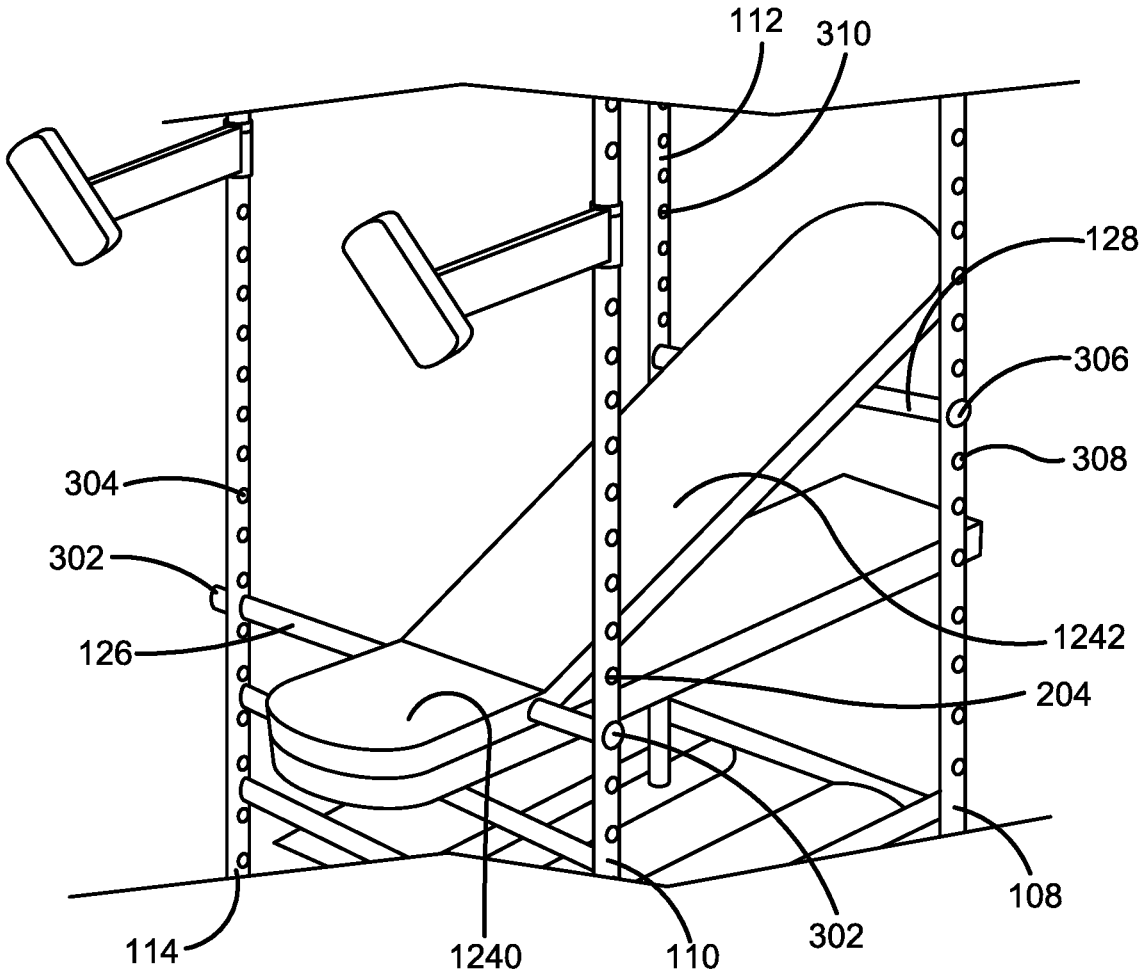
FIG. 3 illustrates a close-up view of the attachment of the adjustable bench on the front legs and rear legs of the adjustable bench device of the present invention in accordance with the disclosed architecture.

FIG. 3 illustrates a close-up view of the attachment of the adjustable bench on the front legs and rear legs. As shown the adjustable bench 124 comprises a laying surface 1242 and a sitting portion 1240. The adjustable bench 124 is secured to the front legs 110, 114 using the adjustable front bench support 126 and screwing or mounting pins 302 are inserted into one of the holes 204 in the first front leg 110 and into one of the holes 304 of the second front leg 114. The adjustable front bench support 126 can be adjusted in height by screwing the mounting pins 302 into the desired holes 204, 304 in each leg 110, 114. Thus, by adjusting the height of the front bench support 126, the height of the adjustable bench 124 can be increased. Similarly, for tilting, inclination or declination of the laying portion 1242, the adjustable rear bench support 128 which supports the laying portion 1242, can be adjusted in height by inserting the mounting or screwing pins 306 into one of the holes 308 of the first rear leg 108 and inserting the mounting or screwing pins 306 into one of the holes 310 of the second rear leg 112.

The adjustable bench 124 is inclined when said adjustable rear bench support 128 is positioned higher than the adjustable front bench support 126, the adjustable bench 124 is declined when said adjustable rear bench support 128 is positioned lower than the adjustable front bench 126 support, and the adjustable bench 124 is flat when said adjustable rear bench support 128 is positioned at the same level as the adjustable front bench support 126.

Figure 4:
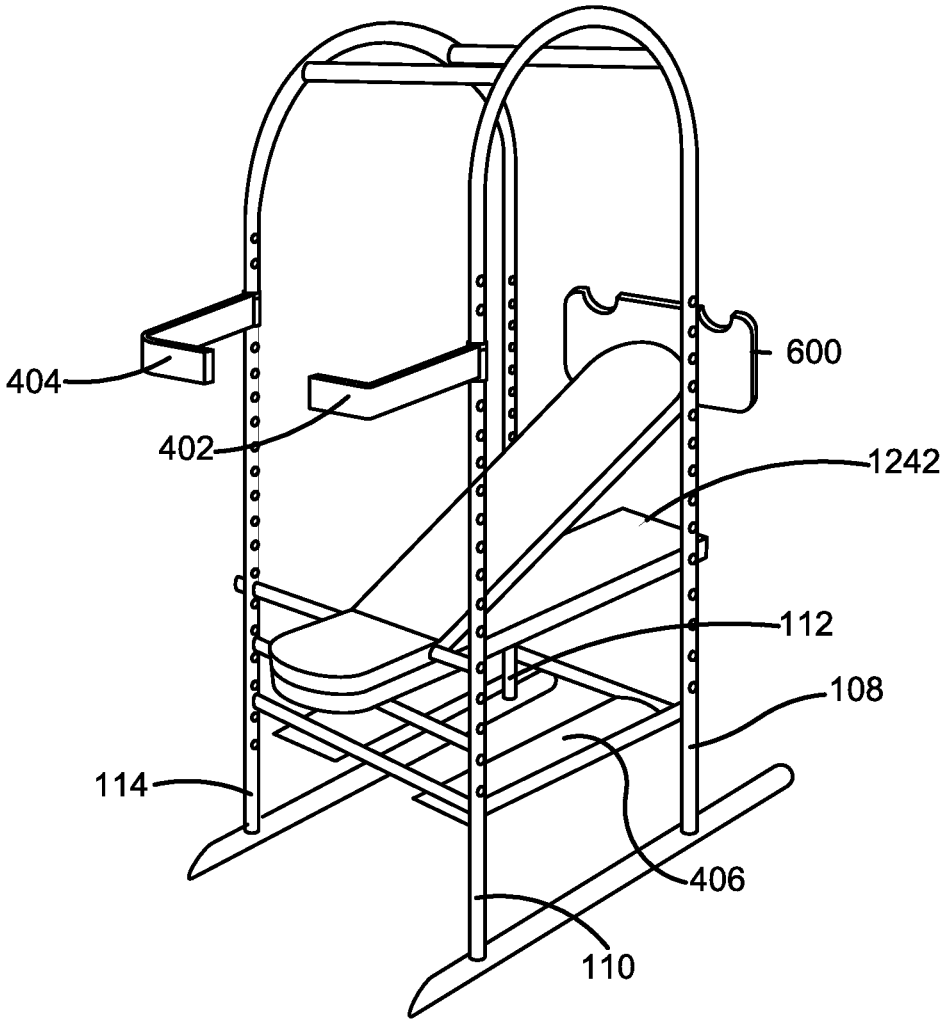
FIG. 4 illustrates a perspective view showing another embodiment of the footrests attachment secured to the front legs of the adjustable bench device of the present invention in accordance with the disclosed architecture.

FIG. 4 illustrates a perspective view showing another embodiment of the footrest attachment secured to the front legs of the adjustable bench device. In the present embodiment, L-shaped footrests 402, 404 are detachably-secured to the first front leg 110 and the second front leg 114 respectively. The L-shaped footrests 402, 404 can be positioned at varying heights along the front legs 110, 114 as per a user's wants and/or needs. In addition, one embodiment of the footrests 402, 404 may be detachably secured to the rear legs 108,112, wherein the footrests 402, 404 extend towards the front legs 110, 114. In any embodiment, the footrests 402, 404 may be extendable/adjustable in length. Further, a climbing platform 406 can be used for climbing onto the laying portion 1242 of the adjustable bench 124. As shown, the laying portion 1242 is positioned flat between the pair of front legs 110, 114 and the pair of rear legs 108, 112. The laying portion 1242 can further be inclined or declined to perform sexual intercourse in various positions.

Figure 5:
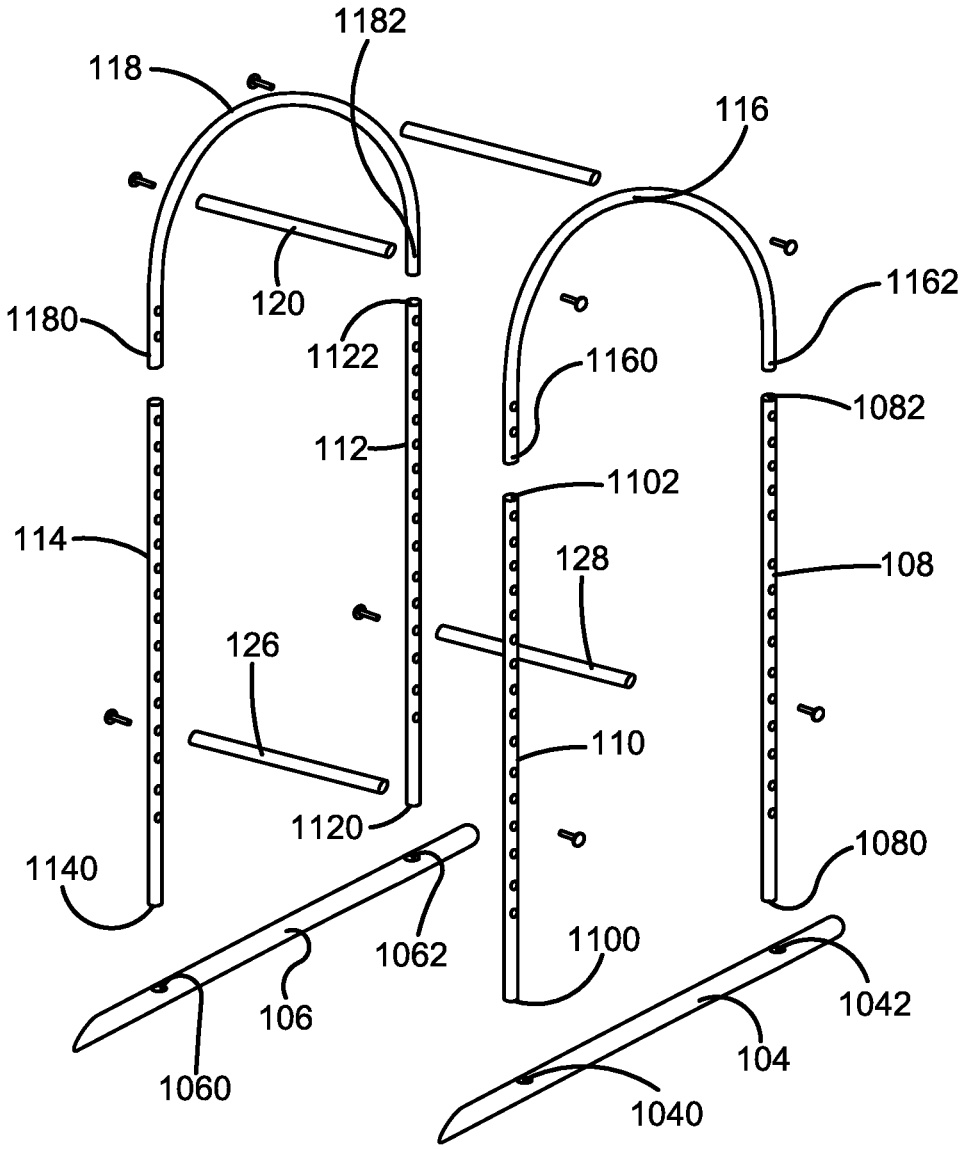
FIG. 5 illustrates an exploded perspective view of the frame of the adjustable bench device of the present invention in accordance with the disclosed architecture.

FIG. 5 illustrates an exploded view of the frame of the adjustable bench device of the present invention. As shown, the first base arm 104 has a first cavity 1040 for receiving the bottom end 1100 of the first front leg 110. A second cavity 1042 of the first base arm 104 receives the bottom end 1080 of the first rear leg 108. Then, a U-shaped rail 116 is used to connect the top end 1102 of the first front leg 110 and the top end 1082 of the first rear leg 108 together. Specifically, the U-shaped rail 116 comprises a first hole 1160 which receives the top end 1102 of the first front leg 110 and the second hole 1162 receives the top end 1082 of the first rear leg 108. Similarly, the second base arm 106 has a first cavity 1060 for receiving the bottom end 1140 of the second front leg 114. A second cavity 1062 of the second base arm 106 receives the bottom end 1120 of the second rear leg 112. Then, a second U-shaped rail 118 is used to connect the top end 1142 of the second front leg 114 and the top end 1122 of the second rear leg 112 together. Specifically, the second U-shaped rail 118 comprises a first hole 1180 which receives the top end 1142 of the second front leg 114 and the second hole 1182 receives the top end 1122 of the second rear leg 112.

Thus, the U-shaped rails 116, 118 are connected to each other for additional support using mounting screws with the supporting arms 120, 122. Further, the adjustable bench front and rear supports 126, 128 are adjusted and mounted as described earlier using screwing or mounting pins 302, 306 to the front legs 110, 114 and to the rear legs 108, 112 as stated in FIG. 3.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "intercourse facilitating adjustable bench device", "adjustable bench device", "device", and "sexual intercourse adjustable device" are interchangeable and refer to the intercourse facilitating adjustable bench device 100 of the present invention.

Notwithstanding the forgoing, the intercourse facilitating adjustable bench device 100 of the present invention can be of any suitable size and configuration as is known in the art without affecting the overall concept of the invention, provided that it accomplishes the above-stated objectives. One of ordinary skill in the art will appreciate that the size, configuration, and material of the intercourse-facilitating adjustable bench device 100 as shown in FIGS. 1-5 is for illustrative purposes only, and that many other sizes and shapes of the intercourse-facilitating adjustable bench device 100 are well within the scope of the present disclosure. Although the dimensions of the intercourse-facilitating adjustable bench device 100 are important design parameters for user convenience, the intercourse-facilitating adjustable bench device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An adjustable bench device for sexual intercourse comprising:

a frame comprising a first base arm, a second base arm, a first and a second front leg, a first and a second rear leg, and a first and a second U-shaped rail;

an adjustable bench mounted on the frame;

a pair of footrests for providing support to legs of a user during sexual intercourse; and a pair of wrist straps for wrapping hands of a user, wherein the frame, the adjustable bench, the pair of footrests, and the pair of wrist straps are all adjustable and are configured to be locked in a specific position and orientation which is configured to allow users to enjoy sexual intercourse while maintaining stability and balance; and wherein each footrest is configured to flip inward when not in use;

wherein the frame is cushioned;

wherein the first base arm comprises a first front leg receiving cavity and a first rear leg receiving cavity for detachably receiving and securing the first front and rear legs respectively; and wherein the second base arm comprises a second front leg receiving cavity and a second rear leg receiving cavity for detachably receiving and securing the second front and rear legs respectively.

2. The adjustable bench device of claim 1, wherein the adjustable bench comprises an adjustable front bench support and an adjustable rear bench support.

3. The adjustable bench device of claim 2, wherein the adjustable front bench support connects the first and the second front legs together.

4. The adjustable bench device of claim 3, wherein the adjustable rear bench support connects the first and the second rear legs together.

5. The adjustable bench device of claim 4, wherein the adjustable rear bench support is mounted to the first and second rear legs via a mounting assembly and the adjustable front bench support is mounted to the first and second front legs via a mounting assembly.

6. The adjustable bench device of claim 5, wherein each mounting assembly comprises mounting pins which are inserted into through holes positioned along a length of the first and second front legs and the first and second rear legs.

7. The adjustable bench device of claim 1, wherein the first rear leg and the first front leg are connected together at a top via the first U-shaped rail.

8. The adjustable bench device of claim 7, wherein the second rear leg and the second front leg are connected together at a top via the second U-shaped rail.

9. The adjustable bench device of claim 8, wherein a first and a second connecting arm spans the first and the second U-shaped rails horizontally, connecting the first and the second U-shaped rails together.

10. The adjustable bench device of claim 1, wherein the first and the second rear legs and the first and the second front legs are telescoping such that overall height of the frame is configured to be adjusted.

11. The adjustable bench device of claim 1, wherein the pair of footrests are detachably secured to the first and the second front legs of the frame.

12. The adjustable bench device of claim 1, wherein the pair of wrist straps are detachably secured to the first and the second rear legs of the frame.

13. An adjustable bench device for sexual intercourse comprising:

a frame comprising a first base arm, a second base arm, a first and a second front leg, a first and a second rear leg, and a first and a second U-shaped rail;

an adjustable bench comprising a seating member and a frame, the adjustable bench is mounted on the frame;

a pair of footrests are detachably secured to the first and the second front legs and are adjustable along a length of the first and the second front legs; and a pair of wrist straps are detachably secured to the first and the second rear legs and are adjustable along a length of the first and the second rear legs;

wherein the first rear leg and the first front leg are connected together via the first U-shaped rail;

wherein the second rear leg and the second front leg are connected together via the second U-shaped rail; and wherein the frame, the adjustable bench, the pair of footrests, and the pair of wrist straps are all adjustable and are configured to be locked in a specific position and orientation which is configured to allows users to enjoy sexual intercourse while maintaining stability and balance; and wherein each footrest is extendable in length and configured to flip inward when not in use;

wherein the first base arm comprises a first front leg receiving cavity and a first rear leg receiving cavity for detachably receiving and securing the first front and rear legs respectively; and wherein the second base arm comprises a second front leg receiving cavity and a second rear leg receiving cavity for detachably receiving and securing the second front and rear legs respectively.

14. The adjustable bench device of claim 13, wherein the adjustable front bench support connects the first and the second front legs together via a mounting assembly and the adjustable rear bench support connects the first and the second rear legs together via a mounting assembly.

15. The adjustable bench device of claim 13, wherein the pair of footrests are detachably secured to the first and the second front legs via a mounting assembly which engages one of a plurality holes disposed on each of the first and the second front legs with a mounting pin.

16. The adjustable bench device of claim 13, wherein the pair of wrist straps are detachably secured to the first and the second rear legs via a mounting assembly which engages one of a plurality holes disposed on each of the first and the second rear legs with a mounting pin.

17. An adjustable bench device for sexual intercourse comprising:

a frame comprising a first base arm, a second base arm, a first and a second front leg, a first and a second rear leg, and a first and a second U-shaped rail;

an adjustable bench comprising a seating member and a frame, an adjustable front bench support and an adjustable rear bench support, wherein the adjustable front bench support connects the first and the second front legs together via a mounting assembly and the adjustable rear bench support connects the first and the second rear legs together via a mounting assembly, such that the adjustable bench is configured to be positioned at varying heights along the first and the second front legs and the first and the second rear legs;

a pair of L-shaped footrests are detachably secured to the first and the second front legs and are adjustable along a length of the first and the second front legs via a mounting assembly which engages one of a plurality holes disposed on each of the first and the second front legs with a mounting pin; and a pair of wrist straps are detachably secured to the first and the second rear legs and are adjustable along a length of the first and the second rear legs via a mounting assembly which engages one of a plurality holes disposed on each of the first and the second rear legs with a mounting pin; and a climbing platform secured to the frame which is configured to allow a user to climb onto the adjustable bench, wherein the first rear leg and the first front leg are detachably secured to and extend from the first base arm and are connected together via the first U-shaped rail, and further wherein the second rear leg and the second front leg are detachably secured to and extend from the second base arm and are connected together via the second U-shaped rail; and a removable kneeling platform attached to the frame; and wherein the seating member of the adjustable bench comprises a laying surface; and wherein each footrest is extendable in length and configured to flip inward when not in use;

wherein the first base arm comprises a first front leg receiving cavity and a first rear leg receiving cavity for detachably receiving and securing the first front and rear legs respectively; and wherein the second base arm comprises a second front leg receiving cavity and a second rear leg receiving cavity for detachably receiving and securing the second front and rear legs respectively.

* * * * *